US005755443A

United States Patent [19]

Huang

[11] Patent Number: 5,755,443

[45] Date of Patent: May 26, 1998

[54] DART GAME CONTROLLER THAT ADJUSTS ONE SCORE TO EFFECT OTHER SCORES

[76] Inventor: Chun-Mu Huang, 6th Fl., No. 60-5, Cheng I S. Rd., Sanchung City, Taipei Hsien, Taiwan

[21] Appl. No.: 677,885

[22] Filed: Jul. 10, 1996

[51] Int. Cl.[6] ..... F41J 5/14

[52] U.S. Cl. ..... 273/371; 273/376; 364/411

[58] Field of Search ..... 273/371, 372, 273/373, 376; 364/411, 410; 340/323 R

[56] References Cited

U.S. PATENT DOCUMENTS

| | | | |
|---|---|---|---|
| 4,415,162 | 11/1983 | Sheppard | 273/371 |
| 4,793,618 | 12/1988 | Tillery et al. | 273/376 |
| 5,020,806 | 6/1991 | Martin | 273/371 |
| 5,156,643 | 10/1992 | Grubek | 273/376 |
| 5,318,319 | 6/1994 | Jones et al. | 273/371 |
| 5,384,561 | 1/1995 | Smith | 364/411 X |
| 5,553,861 | 9/1996 | Pan | 273/371 |
| 5,559,490 | 9/1996 | McDonald et al. | 364/411 X |

FOREIGN PATENT DOCUMENTS

| | | | |
|---|---|---|---|
| 2 130 107 | 5/1984 | United Kingdom . | |
| 2 133 296 | 7/1984 | United Kingdom . | |
| WO 88/0363 | 5/1988 | WIPO . | |
| WO 88/03887 | 6/1988 | WIPO . | |
| WO 92/14983 | 9/1992 | WIPO . | |
| 9409337 | 4/1994 | WIPO | 273/371 |

*Primary Examiner*—Jessica Harrison
*Assistant Examiner*—Michael O'Neill
*Attorney, Agent, or Firm*—Madson & Metcalf

[57] ABSTRACT

The present invention is related to a controller for controlling the proceeding of a dart game provided for a plurality of players. The controller is mounted in an electronic dartboard and includes a calculator for calculating and storing respective scores of the plurality of players; a comparator electrically connected to the calculator for comparing a newly calculated score of the respective player with each of the other scores stored in the calculator, and then generating an adjusting signal when any of the compared results shows a predetermined relationship; and an arbitrator electrically connected to the calculator and the comparator for adjusting concerned scores in response to the adjusting signal.

35 Claims, 3 Drawing Sheets

DART GAME CONTROLLER THAT ADJUSTS ONE SCORE TO EFFECT OTHER SCORES

FIELD OF THE INVENTION

The present invention is related to a controller, and more particularly to a controller for controlling the proceeding of a dart game provided for a plurality of players.

BACKGROUND OF THE INVENTION

In order to prevent from the inconvenience caused by artificial scoring, an electronic dartboard has been used for replacing the conventional non-electronic dartboard, and has become a main stream in the field of the dart game. Accompanying the enhancement of the scoring function of a dartboard devices an electronic dartboard device able to be applied to a variety of dart games is provided. In most dart games, players sequentially throws darts for scoring their own points without any relationship among the scores. In other words, one player cannot influence the scores of the others by hitting to obtain a specific score during the entire game so that the dart game will be less exciting, for lack of correlation among the scores. For purpose of improving the exciting degree of a dart game, the present invention proposes a scheme and provides a hardware device as follows.

SUMMARY OF THE INVENTION

The present invention is related to a controller for controlling the proceeding of a dart game provided for a plurality of players, wherein the controller is mounted in an electronic dartboard and includes a calculator for calculating and storing respective scores of the plurality of players; a comparator electrically connected to the calculator for comparing a newly calculated score of the respective player with each of the other scores stored in the calculator, and then generating an adjusting signal when any of the compared results shows a predetermined relationship; and an arbitrator electrically connected to the calculator and the comparator for adjusting concerned scores in response to the adjusting signal.

The electronic dartboard that the controller is mounted in preferably includes a target board having thereon a plurality of target blocks representing various numbers of points; a matrix sensing circuit electrically connected to the calculator: of the controller for sensing which target block is hit and then sending a number of points represented by the hit target block to the calculator to be calculated; and a display electrically connected to the calculator of the controller for displaying respective current scores of the plurality players.

In addition, the present controller preferably further includes a player switching device electrically connected to the calculator which is switched to calculate a score of the next player after a player has finished a predetermined number of effective throws.

In a preferred embodiment, the comparator compares numbers at unit and tens places of the newly calculated score of the respective player with those of each of the other scores stored in the calculator. The comparator generates the adjusting signal when the numbers at unit and tens places of the newly calculated score of the respective player are equal to those of any one of the other scores stored in the calculator. A score of each of the players begins with an initial value and the score is renewed whenever a new hit is made by way of accumulatedly subtracting each number of points resulting from each new hit from the initial value. The arbitrator adjusts the concerned scores by way of keeping the newly calculated score of the respective player unchanged but resetting the score stored in the calculator and equal to the newly calculated score of the respective player to its initial value.

Alternatively, the arbitrator adjusts the concerned scores by way of adding bonus points to the newly calculated score of the respective player but resetting the score stored in the calculator and equal to the newly calculated score of the respective player to its initial value.

Also, a score of each of the players can begin with an initial value and the score is renewed whenever a new hit is made by way of accumulatedly adding each number of points resulting from each new hit to the initial value. The arbitrator adjusts the concerned scores by way of keeping the newly calculated score of the respective player unchanged but resetting the score stored in the calculator and equal to the newly calculated score of the respective player to its initial value.

Alternatively, the arbitrator adjusts the concerned scores by way of adding bonus points to the newly calculated score of the respective player but resetting the score stored in the calculator and equal to the newly calculated score of the respective player to its initial value. Alternatively, the arbitrator adjusts the concerned scores by way of keeping the newly calculated score of the respective player unchanged but resetting the score stored in the calculator and equal to the newly calculated score of the respective player to zero.

Alternatively, the arbitrator adjusts the concerned scores by way of adding bonus points to the newly calculated score of the respective player but resetting the score stored in the calculator and equal to the newly calculated score of the respective player to zero.

Alternatively, the arbitrator adjusts the concerned scores by way of keeping the newly calculated score of the respective player unchanged but resetting the score stored in the calculator and equal to the newly calculated score of the respective player to half of its value.

Alternatively, the arbitrator adjusts the concerned scores by way of adding bonus points to the newly calculated score of the respective player but resetting the score stored in the calculator and equal to the newly calculated score of the respective player to half of its value.

In another preferred embodiment, the comparator compares a number at the unit place of the newly calculated score of the respective player with that of each of the other scores stored in the calculator. The comparator generates the adjusting signal when the number at the unit place of the newly calculated score of the respective player is equal to that of any one of the other scores stored in the calculator. A score of each of the players begins with an initial value and the score is renewed whenever a new hit is made by way of accumulatedly subtracting each number of points resulting from each new hit from the initial value. The arbitrator adjusts the concerned scores by way of resetting the score stored in the calculator and equal to the newly calculated score of the respective player to its initial value. In addition, the arbitrator can optionally adjust the concerned scores by way of further adding bonus points to the newly calculated score of the respective player.

Alternatively, a score of each of the players begins with an initial value and the score is renewed whenever a new hit is made by way of accumulatedly adding each number of points resulting from each new hit to tine initial value. The arbitrator adjusts the concerned scores by way of resetting the score stored in the calcullator and equal to the newly calculated score of the respective player to its initial value. The arbitrator adjusts the concerned scores by way of resetting the score stored in the calculator and equal to the newly calculated score of the respective player to zero.

Alternatively, the arbitrator adjusts the concerned scores by way of resetting the score stored in the calculator and equal to the newly calculated score of the respective player to half of its value.

Alternatively, the arbitrator can further adjust the concerned scores by way of adding bonus points to the newly calculated score of the respective player.

In accordance with another aspect of the present invention, a controller for controlling the proceeding of a dart game provided for a plurality of players, wherein the controller is mounted in an electronic dartboard and includes a calculator for calculating and storing respective scores of the plurality of players; a comparator electrically connected to the calculator for comparing a newly calculated score of the respective player with each of the other scores stored in the calculator, and then sending out an adjusting signal when any of the compared results shows a predetermined relationship; and an arbitrator electrically connected to the calculator and the comparator for adjusting concerned scores and marking the respective player once in response to the adjusting signal.

The electronic dartboard that the controller is mounted in includes a target board having thereon a plurality of target blocks representing various numbers of points; a matrix sensing circuit electrically connected to the calculator of the controller for sensing which target block is hit and then sending a number of points represented by the hit target block to the calculator to be calculated; and a display electrically connected to the calculator of the controller for displaying respective current scores and showing respective numbers of marks of the plurality layers.

The arbitrator marks the respective player by lightening up a light emitting diode (LED) mounted on the electronic dartboard.

Alternatively, the arbitrator marks the respective player by putting out a light emitting diode (LED) mounted on the electronic dartboard.

Alternatively, the arbitrator marks the respective player by showing a number on a seven segment digital display mounted on the electronic dartboard.

In addition, the controller according to this aspect of the invention further includes a player switching device electrically connected to the calculator which is switched to calculate a score of the next player after a player has finished a predetermined number of effective throws. The comparator compares numbers at unit and tens places of the newly calculated score of the respective player with those of each of the other scores stored in the calculator. The comparator preferably generates the adjusting signal when the numbers at unit and tens places of the newly calculated score of the respective player are equal to those of any one of the other scores stored in the calculator. Alternatively, the comparator compares a number at the unit place of the newly calculated score of the respective player with that of each of the other scores stored in the calculator. The comparator preferably generates the adjusting signal when the number at the unit place of the newly calculated score of the respective player are equal to that of any one of the other scores stored in the calculator.

The foregoing objectives,. features and functions of the present invention will be more readily understood upon a thoughtful deliberation of the following detailed description of two embodiments of the present invention in conjunction with the accompanying drawings.

DETAILED DESCRIPTIONS OF THE PREFERRED EMBODIMENT

Figure 1:
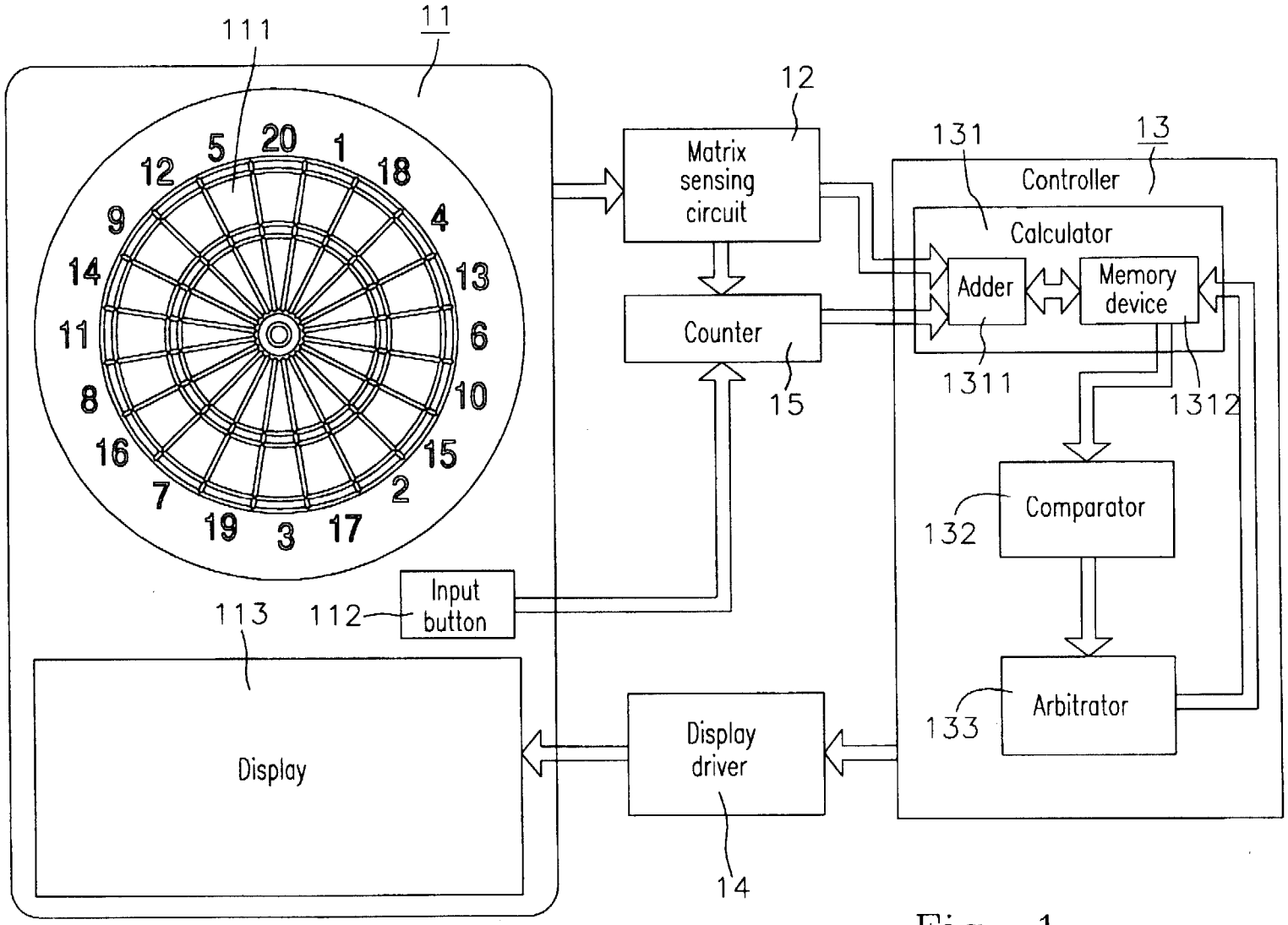
FIG. 1 shows a functional schematic block diagram of a preferred embodiment of a controller according to the present invention used in an electronic dartboard.

Referring to FIG. 1, the controller according to the present invention used in an electronic dartboard is shown. The controller 13 includes a calculator 131 for calculating and storing respective scores of the plurality of players, a comparator 132 electrically connected to the calculator 131 for comparing a newly calculated score of the respective player with each of the other scores stored in the calculator 131, and then generating an adjusting signal when any of the compared results shows a predetermined relationship, and an arbitrator 133 electrically connected to the calculator 131 and the comparator 132 for adjusting concerned scores in response to the adjusting signal. The electronic dartboard in a preferred embodiment includes a target board 11 having thereon a plurality of target blocks 111 representing various numbers of points, a matrix sensing circuit 12 electrically connected to the calculator 131 of the controller 13 for sensing which target block is hit and then sending a number of points represented by the hit target block to the calculator 131 to be calculated, and a display 113 electrically connected to the calculator 131 of the controller 13 for displaying respective current scores of the plurality players. According to the present invention, the calculated scores operated by the calculator 131 can be selected as a positively or negatively accumulated mode. For example, the newly obtained points by each hit of each player can be accumulatedly added to an initial value, such as 0, preset before the game is started, or they can be accumulatedly subtracted from an initial value, such as 400 points, preset before the game is started. Of course, the preset initial values can be different for different players. A preferred embodiment of the controller will be illustrated with reference to FIG. 1 as follows in a positively accumulated mode.

In this preferred embodiment, the respective initial scores of the players are set at first During the game, when a player throws a dart to hit a target block 111 of the dartboard 11, the matrix sensing circuit 12 senses which block is hit and outputs the number of points represented by that hit block to the calculator 131 of the controller 13 to be accumulated to his initial score, or subsequently, his accumulated score. The respective initial scores and/or accumulated scores of the players are stored in a memory device 1312 of the calculator 131. When a target block is hit by a player, an adder 1311 of the calculator 131 reads the stored score corresponding to that player from the memory device 1312, has the newly obtained number of points in response to the new hit added to the score, and then has the resulting score stored back to the memory device 1312. After the player finishes a predetermined number of effective throws, e.g. three times, the calculation operation of the calculator 131 can be switched to the next player's turn trough a player switching device consisting of a counter 15 counting the hit number and an input button 112 That is, in this example, when the counter 15 counts up to three in response to the three effective throws of the player, the matrix sensing circuit 12 is made to pause and the calculator 131 is switched to record the performance of the next player. If any dart fails to hit the dartboard 11 to be sensed and counted after three throws of the player, the player keeps on throwing until totally three darts hit the dartboard 11 in one example or the failure throw is scored zero in another example. Then, the player or others pushes the button 112 to zero the counter 15 and initiate the matrix sensing circuit 12 and the calculator 131.

After each effective throw, the comparator 132 compares the newly calculated score with the scores stored in the memory device 1312 for example by the numbers at unit and tens places of the scores. If the numbers at unit and tens places of the newly calculated score is equal to those of any of the other scores, the comparator 132 will output an adjusting signal to the arbitrator 133 to have concerned scores adjusted. The concerned scores can be adjusted in a way selected from the following groups of:

1) keeping the newly calculated score of the respective player unchanged but resetting the score stored in the calculator and equal to the newly calculated score of the respective player to its initial value;
2) adding bonus points, e.g. 100 points, to the newly calculated score of the respective player but resetting the score stored in the calculator and equal to the newly calculated score of the respective player to its initial value:
3) keeping the newly calculated score of the respective player unchanged but resetting the score stored in the calculator and equal to the newly calculated score of the respective player to zero;
4) adding bonus points to the newly calculated score of the respective player but resetting the score stored in the calculator and equal to the newly calculated score of the respective player to zero;
5) keeping the newly calculated score of the respective player unchanged but resetting the score stored in the calculator and equal to the newly calculated score of the respective player to half of its value; and
6) adding bonus points to the newly calculated score of the respective player but resetting the score stored in the calculator and equal to the newly calculated score of the respective player to half of its value. The game goes on until a player obtains his accumulated score exceeding predetermined points, e.g. 400 points, to be the winner.

Of course, the above design is based on that the score is positively accumulated. On the contrary, if the score is renewed whenever a new hit is made by way of accumulatedly subtracting each number of points resulting from each new hit from its initial value. The arbitrator will adjusts the concerned scores by the following way of:

1) keeping the newly calculated score of the respective player unchanged but resetting the score stored in the calculator and equal to the newly calculated score of the respective player to its initial value; or
2) adding minus points, e.g. −100 points, to the newly calculated score of the respective player as bonus points but resetting the score stored in the calculator and equal to the newly calculated score of the respective player to its initial value.

In this case, the winner will be the first one whose score is negatively accumulated down to or below zero or a preset value.

Of course, the comparison of the scores is not limited to compare the numbers at unit and tens places thereof, it also can be performed by comparing only the number at the unit place thereof.

Figure 2:
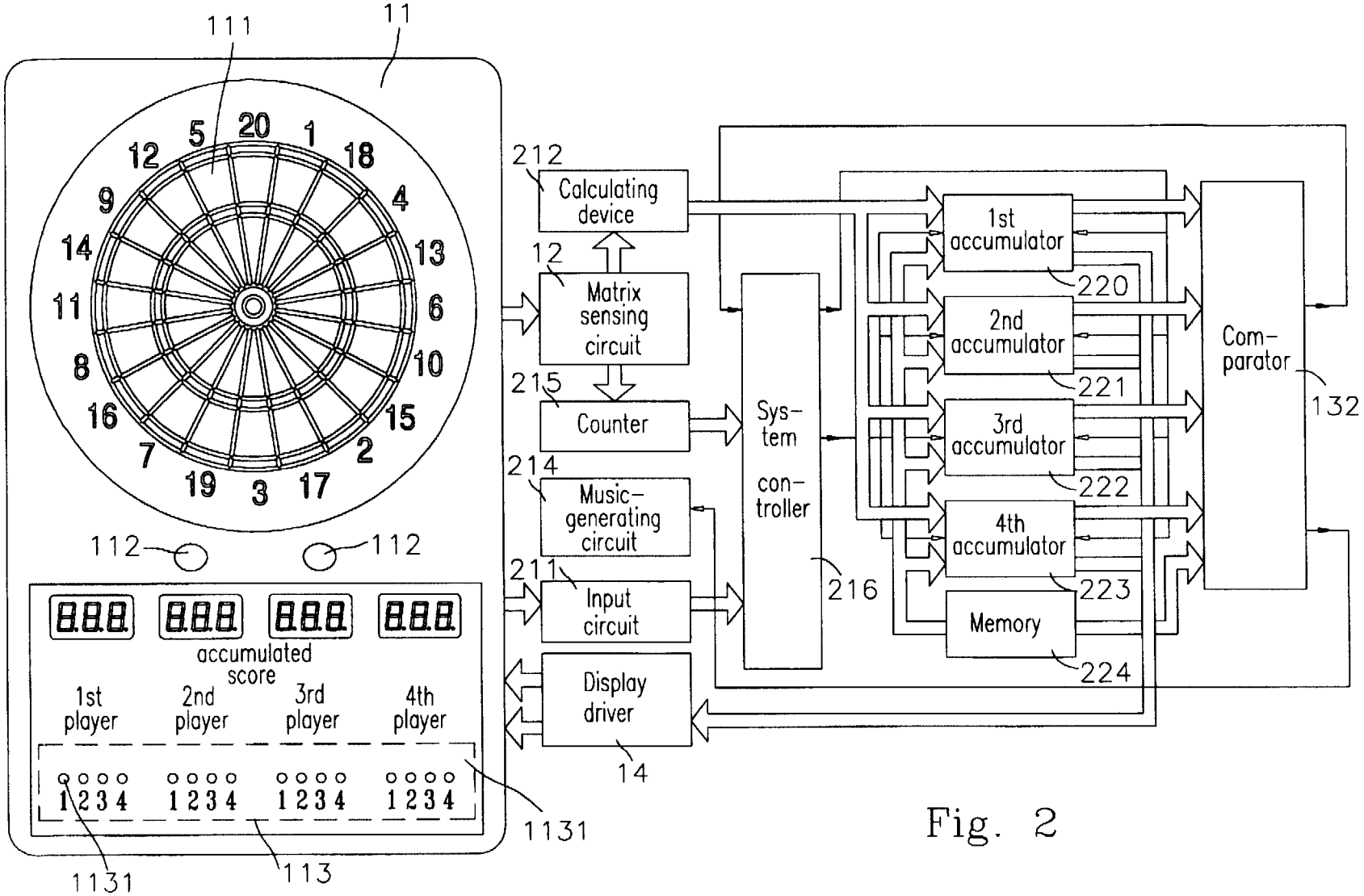
FIG. 2 is a schematic exemplary diagram of a dartboard system using the present controller.

In a preferred embodiment shown in FIG. 2, there are several light emitting diodes (LEDs) 1131 mounted on the dartboard 11 in addition to the devices disclosed in FIG. 1. In this case, the arbitrator 133 adjusts concerned scores mentioned in the preceding paragraphs and, at the same time, marks the respective player once in response to the adjusting signal by way of turning on or putting out one of the LEDs which are initially dark or light. The one who first complies with the requirement of score or that of the number of marks will be the winner.

Of course, the arbitrator 133 can alternatively mark the respective player by displaying the number of marks on a seven-segment digital display instead of marking the player by LEDs.

Figure 3:
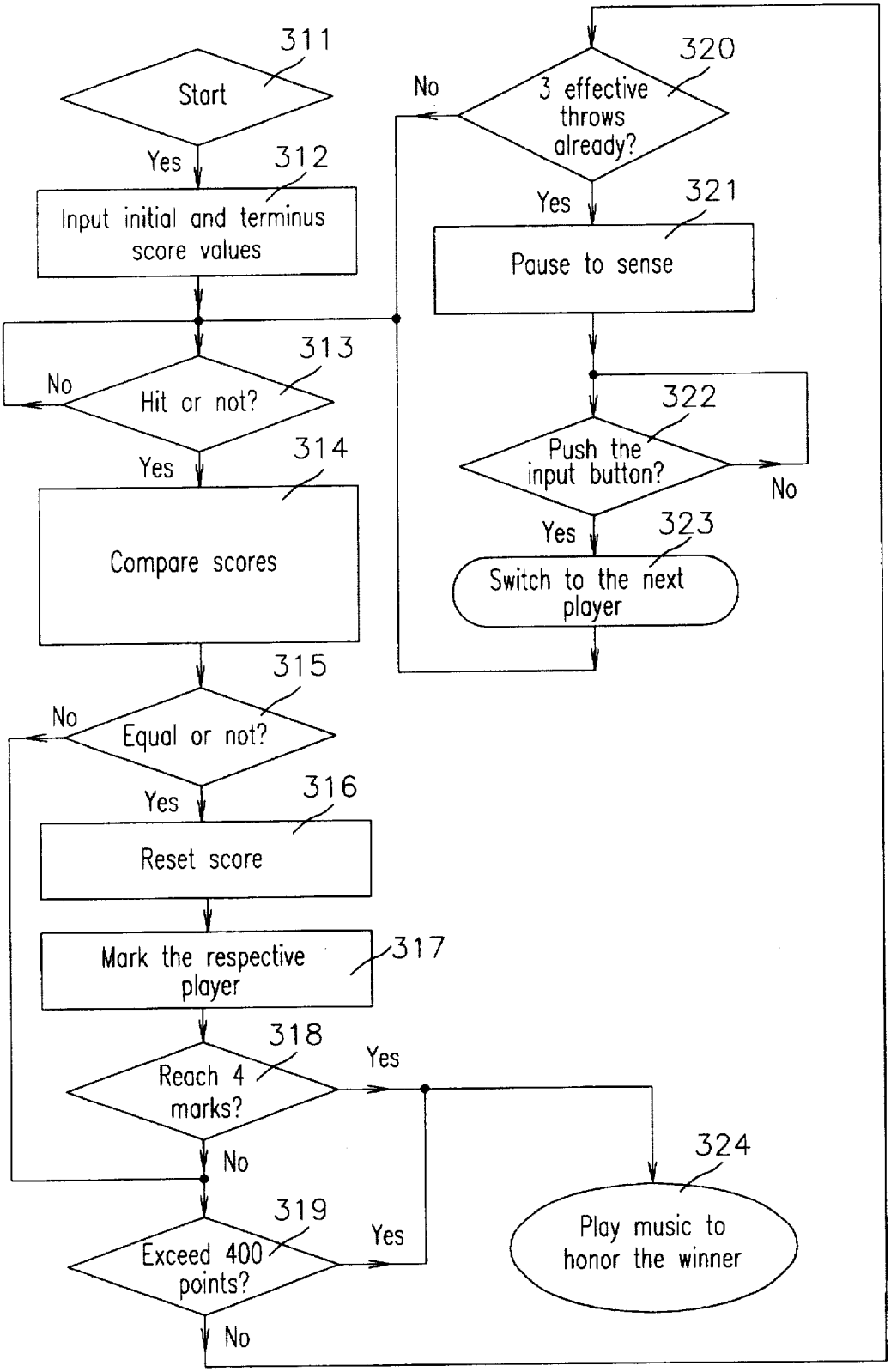
FIG. 3 is a flow chart showing the operations of a preferred embodiment of a controller according to the present invention.

The proceeding of a dart game having four players in use of the present controller will be illustrated as follows with reference to FIGS. 1, 2 and 3 for the further understanding of the present invention. It is to be noted that the example below is given by appointing that the scores are accumulatedly added during the game, the comparison of scores is performed by comparing the numbers at the unit and the tens places of the scores, the concerned scores are adjusted in a way that the score of the respective player is maintained and the score equal to the score of the respective player is zeroed, the respective player is marked in a way of turning on the LED, each player can do three effective throw in each turn, and the one who first obtain 400 points or 4 marks will be the winner.

State 311: a start button is pushed to start the game;

State 312: the respective initial scores of the four players and the terminus score value are inputted through a circuit 211 to a memory 224;

State 313: the player throws a dart and the matrix sensing circuit 12 is detects whether any target block is hit, and State 314 will be executed if there is a target block is hit, and otherwise, States 313 will be re-executed;

State 314: the score of the respective player is calculated and stored in response to the newest hit, and the accumulated score of the respective player is compared with the others' scores in the comparator 132;

State 315: if the comparing result shows that the numbers at the unit and tens places of the accumulated score of the respective player are equal to those of one of the scores stored in the memory device 1312, State 316 is executed, and otherwise, State 319 is executed;

State 316: the score having numbers at unit and tens places equal to those of the score of the respective player is zeroed;

State 317; one LED 1131 is turned on to mark the respective player once;

State 318: if the number of the lightened LED is accumulated to four, State 324 will be executed, and otherwise, State 319 will be executed;

State 319: if the accumulated score of the respective player is up to or exceeds 400 points, State 324 will be executed, and otherwise, State 320 will be executed;

State 320: if the player has effectively thrown three times, State 321 will be executed, and otherwise, State 313 will be executed;

State 321: the matrix sensing circuit 12 is made to pause;

State 322: if the input button 112 is pushed, State 323 will be executed, and otherwise, State 322 is re-executed;

State 323: the system is switched for the next player and State 313 is executed;

State 324: a music-generating device 214 is initiated to play music to honor the winner.

As for the operations in State 316, several assumed scores are given in a table as an example for further illustration.

| | 1st run | 2nd run | 3rd run |
|---|---|---|---|
| 1st player | 17 + 16 + 14 = 47 | + 20 + 20 + 20 = 107 | + 12 + 15 + 15 = $149^b \rightarrow 0$ |
| 2nd player | 10 + 8 + 4 = 22 | + 12 + 4 + 6 = 44 | + 5 = $49^b$ +1 + 10 = $60^c \rightarrow 0$ |
| 3rd player | 3 + 5 + 19 = 27 | + 4 + 7 + 19 = $57^a \rightarrow 0$ | 19 + 11 + 7 = 37 |
| 4th player | 4 + 16 + 17 = 37 | + 6 + 13 + 1 = $57^a$ | + 2 + 1 = $60^c$ + 15 = 75 |

Now referring again to FIG. 2, the calculating device 212 and the accumulators 220, 221, 222 and 223 respectively for the four players are combined as the calculator shown in FIG. 1.

While the invention has been described in terms of what are presently considered to be the most practical and preferred embodiments, is it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A controller for controlling the proceeding of a dart game provided for a plurality of players, said controller for use in an electronic dartboard and comprising:

a calculator for calculating and storing respective scores of a plurality of players;

a comparator electrically connected to said calculator for comparing a newly calculated score of a player with each of the other scores stored in said calculator, and then generating an adjusting signal when any of the compared results shows a predetermined relationship; and an arbitrator electrically connected to said calculator and said comparator for adjusting concerned scores in response to said adjusting signal.

2. The controller according to claim 1 further comprising a player switching device electrically connected to said calculator which is switched to calculate a score of a next player after a player has finished a predetermined number of effective throws.

3. The controller according to claim 2 wherein said comparator compares numbers at unit and tens places of said newly calculated score with those of each of said other scores stored in said calculator.

4. The controller according to claim 3 wherein said comparator generates said adjusting signal when said numbers at unit and tens places of said newly calculated score are equal to those of any one of said other scores stored in said calculator.

5. The controller according to claim 4 wherein a score of each player begins with an initial value and said score is renewed whenever a new hit is made by way of accumulatedly subtracting each number of points resulting from each new hit from said initial value.

6. The controller according to claim 5 wherein said arbitrator adjusts said concerned scores by way of keeping said newly calculated score unchanged but resetting said score stored in said calculator and equal to said newly calculated score to its initial value.

7. The controller according to claim 5 wherein said arbitrator adjusts said concerned scores by way of adding bonus points to said newly calculated score but resetting said score stored in said calculator and equal to said newly calculated score to its initial value.

8. The controller according to claim 4 wherein a score of each player begins with an initial value and said score is renewed whenever a new hit is made by way of accumulatedly adding each number of points resulting from each new hit to said initial value.

9. The controller according to claim 8 wherein said arbitrator adjusts said concerned scores by way of keeping said newly calculated score unchanged but resetting said score stored in said calculator and equal to said newly calculated score to its initial value.

10. The controller according to claim 8 wherein said arbitrator adjusts said concerned scores by way of adding bonus points to said newly calculated score but resetting said score stored in said calculator and equal to said newly calculated score to its initial value.

11. The controller according to claim 8 wherein said arbitrator adjusts said concerned scores by way of keeping said newly calculated score unchanged but resetting said score stored in said calculator and equal to said newly calculated score to zero.

12. The controller according to claim 8 wherein said arbitrator adjusts said concerned scores by way of adding bonus points to said newly calculated score but resetting said score stored in said calculator and equal to said newly calculated score to zero.

13. The controller according to claim 8 wherein said arbitrator adjusts said concerned scores by way of keeping said newly calculated score unchanged but resetting said score stored in said calculator and equal to said newly calculated score to half its value.

14. The controller according to claim 8 wherein said arbitrator adjusts said concerned scores by way of adding bonus points to said newly calculated score but resetting said score stored in said calculator and equal to said newly calculated score to half its value.

15. The controller according to claim 2 wherein said comparator compares a number at the unit place of said newly calculated score with that of each of said other scores stored in said calculator.

16. The controller according to claim 15 wherein said comparator generates said adjusting signal when said number at the unit place of said newly calculated score is equal to that of any one of said other scores stored in said calculator.

17. The controller according to claim 16 wherein a score of each player begins with an initial value and said score is renewed whenever a new hit is made by way of accumulatedly subtracting each number of points resulting from each new hit from said initial value.

18. The controller according to claim 17 wherein said arbitrator adjusts said concerned scores by way of resetting said score stored in said calculator and equal to said newly calculated score to its initial value.

19. The controller according to claim 18 wherein said arbitrator adjusts said concerned scores by way of further adding bonus points to said newly calculated score.

20. The controller according to claim 16 wherein a score of each player begins with an initial value and said score is renewed whenever a new hit is made by way of accumulatedly adding each number of points resulting from each new hit to said initial value.

21. The controller according to claim 20 wherein said arbitrator adjusts said concerned scores by way of resetting said score stored in said calculator and equal to said newly calculated score to its initial value.

22. The controller according to claim 20 wherein said arbitrator adjusts said concerned scores by way of resetting said score stored in said calculator and equal to said newly calculated score to zero.

23. The controller according to claim 20 wherein said arbitrator adjusts said concerned scores by way of resetting said score stored in said calculator and equal to said newly calculated score to half its value.

24. The controller according to claim 20 wherein said arbitrator adjusts said concerned scores by way of adding bonus points to said newly calculated score.

25. A controller for controlling the proceeding of a dart game provided for a plurality of players, said controller for use in an electronic dartboard and comprising:

a calculator for calculating and storing respective scores of a plurality of players;

a comparator electrically connected to said calculator for comparing a newly calculated score of a player with each of the other scores stored in said calculator, and then generating an adjusting signal when any of the compared results shows a predetermined relationship; and an arbitrator electrically connected to said calculator and said comparator for adjusting concerned scores and marking a specified player once in response to said adjusting signal.

26. The controller according to claim 25 wherein said arbitrator marks a specified player by lightening up a light emitting diode (LED) mounted on said electronic dartboard.

27. The controller according to claim 25 wherein said arbitrator marks a specified player by putting out a light emitting diode (LED) mounted on said electronic dartboard.

28. The controller according to claim 25 wherein said arbitrator marks a specified player by showing a number on a seven segment digital display mounted on said electronic dartboard.

29. The controller according to claim 25 wherein said arbitrator marks a specified player by showing a segment on a seven segment digital display mounted on said electronic dartboard.

30. The controller according to claim 25 further comprising a player switching device electrically connected to said calculator which is switched to calculate a score of a next player after a player has finished a predetermined number of effective throws.

31. The controller according to claim 30 wherein said comparator compares numbers at unit and tens places of said newly calculated score with those of each of said other scores stored in said calculator.

32. The controller according to claim 31 wherein said comparator generates said adjusting signal when said numbers at unit and tens places of said newly calculated score are equal to those of any one of said other scores stored in said calculator.

33. The controller according to claim 30 wherein said comparator compares a number at the unit place of said newly calculated score with that of each of said other scores stored in said calculator.

34. The controller according to claim 33 wherein said comparator generates said adjusting signal when said number at the unit place of said newly calculated score is equal to that of any one of said other scores stored in said calculator.

35. An electronic dartboard device comprising of a dartboard body and a controller for controlling the proceeding of a dart game provided for a plurality of players, said controller being mounted in said electronic dartboard device and comprising:

a calculator for calculating and storing respective scores of a plurality of players;

a comparator electrically connected to said calculator for comparing a newly calculated score of a player with each of the other scores stored in said calculator, and then generating an adjusting signal when any of the compared results shows a predetermined relationship; and an arbitrator electrically connected to said calculator and said comparator for adjusting concerned scores in response to said adjusting signal; and said dartboard body comprising:

a target board having thereon a plurality of target blocks representing various numbers of points;

a matrix sensing circuit electrically connected to said calculator of said controller for sensing which target block is hit and then sending a number of points represented by said hit target block to said calculator to be calculated; and a display electrically connected to said calculator of said controller for displaying respective current score of each player.

* * * * *

UNITED STATES PATENT AND TRADEMARK OFFICE

CERTIFICATE OF CORRECTION

PATENT NO. : 5,755,443
DATED : May 26, 1998
INVENTOR(S) : Chun-Mu Huang

It is certified that error appears in the above-identified patent and that said Letters Patent is hereby corrected as shown below:

In column 3, line 35, delete "layers", and insert therefor -- players -.
In column 4, line 50, insert -- . -- after the word "first".

Signed and Sealed this

Fifteenth Day of September, 1998

*Attest:*

Bruce Lehman

BRUCE LEHMAN

*Attesting Officer*

*Commissioner of Patents and Trademarks*